United States Patent [19]

DeGeorge

[11] 4,289,603

[45] Sep. 15, 1981

[54] CRYOGENIC FRACTIONATOR GAS AS STRIPPING GAS OF FINES SLURRY IN A COKING AND GASIFICATION PROCESS

[75] Inventor: Charles W. DeGeorge, Chester, N.J.

[73] Assignee: Exxon Research & Engineering Co., Florham Park, N.J.

[21] Appl. No.: 910,450

[22] Filed: May 30, 1978

[51] Int. Cl.[2] ..... C10G 1/04; C10G 9/32; C10K 1/08

[52] U.S. Cl. ..... 208/8 LE; 48/197 R; 48/206; 208/127

[58] Field of Search ..... 208/8 R, 127, 8 LE; 48/197 R, 206

[56] References Cited

U.S. PATENT DOCUMENTS

| | | | |
|---|---|---|---|
| 3,901,667 | 8/1975 | Herrmann | 208/127 |
| 3,971,635 | 12/1976 | Matthews | 48/197 R |
| 4,060,478 | 11/1977 | Lang | 208/106 |

*Primary Examiner*—Herbert Levine

*Attorney, Agent, or Firm*—Marthe L. Gibbons; Wayne Hoover

[57] ABSTRACT

In an integrated coking and gasification process wherein a stream of fluidized solids is passed from a fluidized bed coking zone to a second fluidized bed and wherein entrained solid fines are recovered by a scrubbing process and wherein the resulting solids-liquid slurry is stripped with a stripping gas to remove acidic gases, at least a portion of the stripping gas comprises a gas comprising hydrogen, nitrogen and methane separated from the coker products.

18 Claims, 1 Drawing Figure

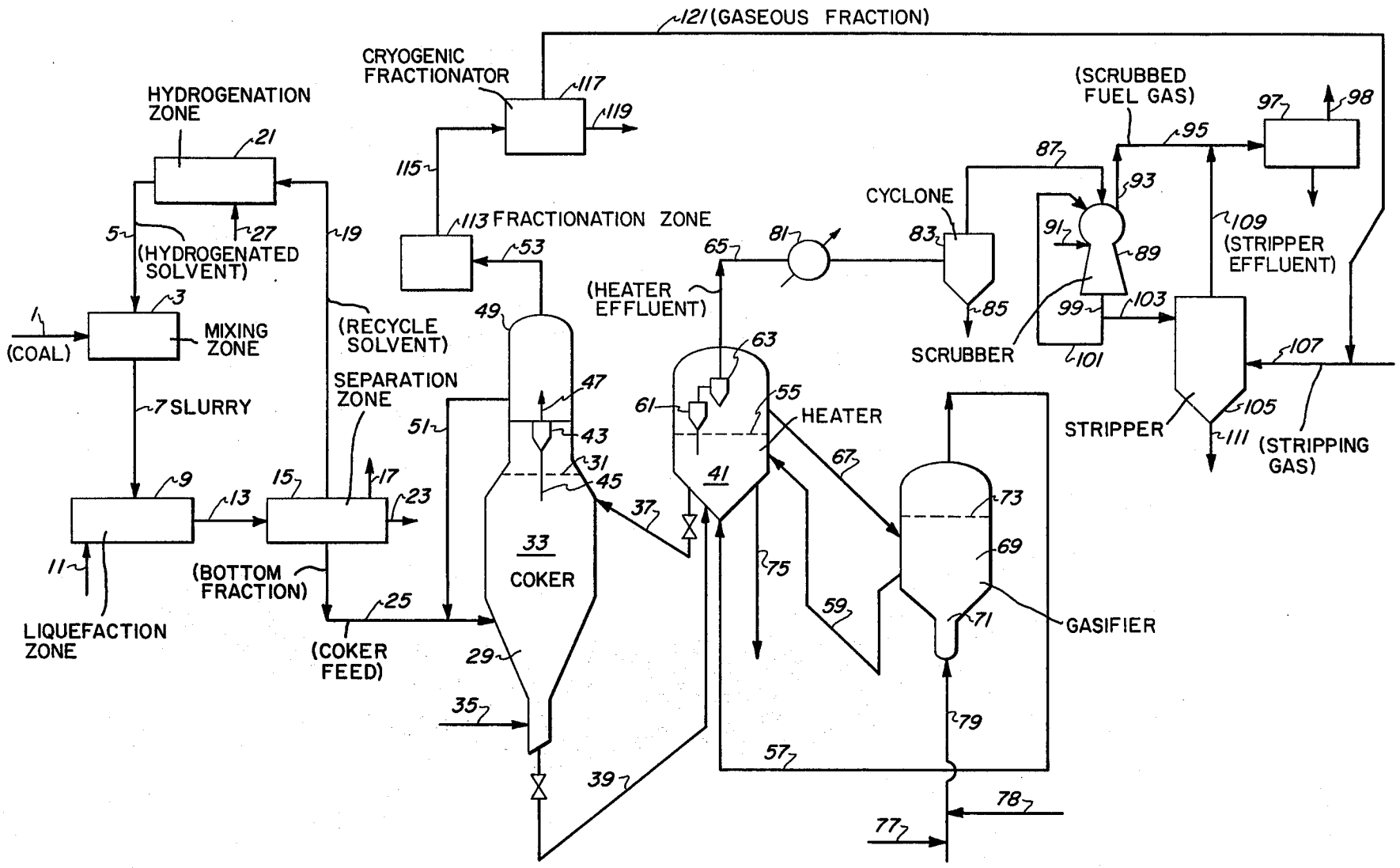
(COAL)
HYDROGENATION ZONE
(HYDROGENATED SOLVENT)
MIXING ZONE
SLURRY
LIQUEFACTION ZONE
(RECYCLE SOLVENT)
SEPARATION ZONE
(BOTTOM FRACTION)
(COKER FEED)
COKER
CRYOGENIC FRACTIONATOR
FRACTIONATION ZONE
(HEATER EFFLUENT)
HEATER
GASIFIER
SCRUBBER
CYCLONE
(SCRUBBED FUEL GAS)
(STRIPPER EFFLUENT)
STRIPPER
(STRIPPING GAS)
(GASEOUS FRACTION)

CRYOGENIC FRACTIONATOR GAS AS STRIPPING GAS OF FINES SLURRY IN A COKING AND GASIFICATION PROCESS

The Government of the United States of America has rights in this invention pursuant to Contract No. E(49-18)-2353 awarded by the U.S. Energy and Research Administration.

BACKGROUND OF THE INVENTION

1. Field of the Invention

This invention relates to an improvement in an integrated fluid coking and gasification process. More particularly, it relates to a combination coal liquefaction, fluid coking and gasification process in which the coal liquefaction bottoms are coked.

2. Description of the Prior Art

It is known to produce fuel gases by integrated fluid coking and gasification processes such as those disclosed in U.S. Pat. Nos. 3,661,543; 3,702,516 and 3,759,676, the teachings of which are hereby incorporated by reference.

It is also known to coke the bottoms of coal liquefaction products in a fluid coking zone in the presence or in the absence of catalysts, see, for example, U.S. Pat. Nos. 3,617,513; 4,060,478 and 4,075,079.

In the integrated fluid coking and gasification process, the gaseous product generally comprises entrained solid fines which are removed from the gas by a wet scrubbing process.

It is desirable to strip acidic gases from the resulting liquid-solid slurry of the wet scrubbing process. It has now been found that the use of the cryogenic fractionator off gas to provide at least a portion of the required stripping gas for the solids-liquid slurry will provide advantages that will become apparent in the ensuing description.

SUMMARY OF THE INVENTION

In accordance with the invention there is provided, in an integrated coking and gasification process comprising the steps of:

(a) reacting a carbonaceous material in a coking zone containing a bed of fluidized solids maintained at fluid coking conditions to produce coke and a vapor phase product including hydrocarbons, said coke depositing on said fluidized solids;

(b) separating from said vapor phase product a gas comprising hydrogen, nitrogen and methane;

(c) introducing a portion of said solids with the coke deposit thereon into a heating zone operated at a temperature greater than said coking zone temperature to heat said portion of solids;

(d) recycling a first portion of heated solids from said heating zone to said coking zone;

(e) introducing a second portion of said heated solids to a fluid bed gasification zone maintained at a temperature greater than said heating zone;

(f) reacting said second portion of heated solids in said gasification zone with steam and an oxygen-containing gas to produce a hot gaseous stream comprising hydrogen;

(g) introducing said hot gaseous stream comprising hydrogen and entrained solids into said heating zone;

(h) passing an additional stream of solids from said gasification zone to said heating zone;

(i) recovering from said heating zone the resulting cooled gaseous stream comprising hydrogen, acidic gases and entrained solids;

(j) separating at least a portion of said entrained solids from said cooled gaseous stream of step (i);

(k) scrubbing the resulting gaseous stream containing said solids with a liquid to form a liquid-solids slurry containing acidic gases and a gaseous stream of decreased solids content;

(l) contacting the liquid-solids slurry with a stripping gas in a stripping zone to remove at least a portion of the acidic gases from said slurry, the improvement which comprises passing at least a portion of said separated gas of step (b) to said stripping zone of step (l).

In accordance with another embodiment of the invention there is provided in a combination coal liquefaction, fluid coking and gasification process which comprises the steps of:

(a) subjecting coal to coal liquefaction conditions in the presence of a hydrogen donor solvent in a coal liquefaction zone to produce a hydrocarbonaceous liquid product and a coal liquefaction bottoms fraction;

(b) passing said coal liquefaction bottoms fraction to a fluid coking zone containing a bed of fluidized solids maintained at fluid coking conditions to produce coke and a vapor phase product including hydrocarbons, said coke depositing on said fluidized solids;

(c) separating from said vapor phase product a gas comprising hydrogen, nitrogen and methane;

(d) introducing a portion of said solids with a coke deposit thereon into a heating zone operated at a temperature greater than said coking zone temperature to heat said portion of solids;

(e) recycling a first portion of heated solids from said heating zone to said coking zone;

(f) introducing a second portion of said heated solids to a fluid bed gasification zone maintained at a temperature greater than said heating zone temperature;

(g) reacting said second portion of heated solids in said gasification zone with steam and an oxygen-containing gas to produce a hot gaseous stream comprising hydrogen;

(h) introducing said hot gaseous stream comprising hydrogen and entrained solids into said heating zone;

(i) passing an additional stream of solids from said gasification zone to said heating zone;

(j) recovering from said heating zone the resulting cooled gaseous stream comprising hydrogen, acidic gases and entrained solids;

(k) separating at least a portion of said entrained solids from said cooled gaseous stream;

(l) scrubbing the resulting gaseous stream containing said solids with a liquid to form a liquid-solids slurry comprising acidic gases and a gaseous stream of decreased solids content;

(m) contacting the liquid-solids slurry with a stripping gas in a stripping zone to remove at least a portion of the acidic gases therefrom, the improvement which comprises passing at least a portion of said separated gas of step (c) to said stripping zone of step (m).

BRIEF DESCRIPTION OF THE DRAWING

The FIGURE is a schematic flow plan of one embodiment of the invention.

DESCRIPTION OF THE PREFERRED EMBODIMENTS

Suitable feeds for the fluid coking stage of the present invention are carbonaceous feeds such as heavy hydrocarbonaceous oils, heavy and reduced petroleum crudes, atmospheric residuum, vacuum residuum, pitch, asphalt, bitumen, other heavy hydrocarbon residues, coal, coal slurries, liquid products derived from coal liquefaction processes. Preferred feeds to the fluid coking stage of the present invention are hydrocarbonaceous oils comprising solids such as the heavy bottoms of coal liquefaction processes and tarsand oil. More preferably, the feed of the fluid coking stage of the present invention is a coal liquefaction bottoms comprising solids which contain a large amount of ash.

The heavy products from coal liquefaction processes, referred to herein as coal liquefaction bottoms, comprise 1000° F.+heavy hydrocarbons, ash and a carbon residue (fusinite). The liquefaction bottoms also comprise unconverted coal, generally from about 40 to about 50 weight percent of the original coal chargestock to the coal liquefaction zone.

Referring to the figure, coal in particulate form of a size ranging up to about ¼ inch particles size diameter, suitably 8 mesh (Tyler) is introduced via line 1 into mixing zone 3 in which it is mixed with a hydrogen donor solvent introduced by line 5. The solvent and coal are admixed in a solvent to coal weight ratio ranging from about 0.8:1 to 4:1, preferably from about 1:1 to 2:1.

The hydrogen donor solvent employed will normally be an intermediate stream boiling between 350° F. and 800° F., preferably between 400° and 700° F., derived from the coal liquefaction process. This stream comprises hydrogenated aromatics, naphthenic hydrocarbons, phenolic material and similar compounds and will normally contain at least 30 weight percent, preferably at least 50 weight percent of compounds which are known to be hydrogen donors under the temperature and pressure employed in the liquefaction zone. Other hydrogen rich solvents may be used instead or in addition to such coal derived liquids, particularly on initial startup of the process. By the term "hydrogen donor solvent" is intended herein a solvent which contains at least 0.8 weight percent, preferably 1.2 to 3 weight percent or more donatable hydrogen, based on the weight of the solvent. The hydrogen donor solvent may be any of the known hydrogen donor solvents. Suitable hydrogen donor solvents include hydrogenated creosote oil, hydrogenated intermediate product streams from catalytic cracking of petroleum feedstocks and other coal derived liquids which are rich in indane, $C_{10}$ to $C_{12}$ tetralins, decalins, biphenyls, methylnaphthalene, dimethylnaphthalene, hydrogenated dimethyl naphthalene, hydrogenated $C_{12}$ and $C_{13}$ acenaphthenes, tetrahydroacenaphthene and similar donor compounds. The slurry of coal and hydrogen donor solvent is passed via line 7 into coal liquefaction zone 9. Within the coal liquefaction zone 9, the liquefaction conditions include a temperature ranging from about 700° F. to about 950° F., preferably from about 800° F. to about 890° F. with pressures ranging from about 300 psia to about 3000 psia, preferably from about 800 psia to about 2000 psia. Preferably, molecular hydrogen is also added to liquefaction zone 9 via line 11 at a rate of 500 to 10,000 standard cubic feet per barrel, preferably 1000 to 6000 standard cubic feet per barrel. The product from the coal liquefaction zone comprises a mixture of gases, liquids, including depleted hydrogen donor solvent, undissolved coal and mineral matter. The liquid mixture is passed via line 13 to separation zone 15. A gas fraction is recovered overhead via line 17. An intermediate fraction, e.g., 400° F. to 700° F., is recovered as hydrogen donor solvent and passed via line 19 to catalytic solvent hydrogenation zone 21. Heavier fractions boiling from about 700° to 1000° F. are recovered via line 23. The heavy bottom fraction boiling at atmospheric pressure above 1000° F. and including char is withdrawn by line 25 for coking as will hereinafter be described. The intermediate fraction (solvent fraction) introduced into catalytic hydrogenation zone is contacted with hydrogen introduced via line 27 in the presence of a catalyst. Suitable conditions in catalytic solvent hydrogenation zone include a temperature ranging from about 650 to about 850° F., preferably from about 700 to about 800° F., and pressures ranging from about 650 psia to about 2000 psia, preferably from about 1000 psia to about 1500 psia. The hydrogen treat rate ranges generally from about 1000 to about 10,000 standard cubic feet per barrel, preferably from about 2000 to about 5000 standard cubic feet per barrel. The hydrogenation catalysts employed are conventional. Typically, such catalysts comprise an alumina or silica-alumina support composited with one or more Group VIII non-noble metals and one or more Group VI metals of the Periodic Table of Elements. Typical catalysts include oxides and/or sulfides of cobalt-molybdenum, nickel-molybdenum, nickel-tungsten, nickel-molybdenum-tungsten, cobalt-nickel-molybdenum and the like. The heavy bottoms fraction removed from separation zone 15 via line 25 is passed into coking zone 29 in which is maintained a fluidized bed of solids (e.g., coke particles of 40 to 1000 microns in size) having an upper level indicated at 31. A fluidizing gas, e.g., steam, is admitted at the base of coking reactor 13 through line 35 in an amount sufficient to obtain superficial fluidizing gas velocity in the range of 0.5 to 5 feet per second. Coke at a temperature above the coking temperature, for example, at a temperature from about 100 to 800 Fahrenheit degrees in excess of the actual operating temperature of the coking zone is admitted to reactor 33 by line 37 in an amount sufficient to maintain the coking temperature in the range of about 850° to about 1400° F., preferably at a temperature of about 900° to about 1200° F. The pressure in the coking zone is maintained in the range of about 5 to about 150 pounds per square inch gauge (psig), preferably in the range of about 5 to about 45 psig. The lower portion of the coking reactor serves as a stripping zone to remove occluded hydrocarbons from the coke. A stream of coke is withdrawn from the stripping zone by line 39 and circulated to heater 41. Conversion products are passed through cyclone 43 to remove entrained solids which are returned to the coking zone through dipleg 45. The vapors leave the cyclone through line 47 and pass into a scrubber 49 mounted on the coking reactor. If desired, a stream of heavy material condensed in the scrubber may be recycled to the coking reactor via line 51. The coker conversion products are removed from scrubber 49 via line 53 for fractionation in a conventional manner in fractionation zone 113. A normally gaseous fraction comprising hydrocarbon gases, hydrogen, and nitrogen is removed from fractionation zone 113 and passed via line 115 to cryogenic fractionation 117. A liquid fraction comprising hydrocarbons is removed via line 119. A gas substantially free of hydrocarbons heavier than methane and comprising hydrogen, nitrogen and methane is removed from cryogenic fractionation zone 117 by line 121 and passed to stripping zone 105 via line 107 to provide at least a portion of the stripping gas. The gas may be used alone or in combination with steam or other inert gases. Typically, the gas removed from cryogenic fractionation zone 117 by line 121 comprises about 50 mole percent hydrogen, about 10 mole percent nitrogen and about 40 mole percent methane. This gas is substantially free of $C_2$ and $C_3$ or heavier hydrocarbons.

In heater 41, stripped coke from coking reactor 33 (commonly called cold coke) is introduced by line 39 to a fluid bed of hot coke having an upper level indicated at 55. The bed is partially heated by passing a fuel gas into a heater by line 57. Supplementary heat is supplied to the heater by coke circulating in line 59. The gaseous effluent of the heater including entrained solids passes through a cyclone which may be a first cyclone 61 and a second cyclone 63 wherein separation of the larger entrained solids occurs. The separated larger solids are returned to the heater bed via the respective cyclone diplegs. The heated gaseous effluent, which still contains entrained solid fines, is removed from heater 41 via line 65. The fines removal system will be subsequently described herein.

Hot coke is removed from the fluidized bed in heater 41 and recycled to coking reactor 33 by line 37 to supply heat thereto. Another portion of coke is removed from heater 41 and passed by line 67 to a gasification zone 69 in gasifier 71 in which is maintained a bed of fluidized coke having a level indicated at 73. If desired, a purge stream of coke may be removed from heater 41 by line 75 or a purge stream of coke may be removed from gasifier 71.

The gasification zone is maintained at a temperature ranging from about 1600° to about 2000° F. and at a pressure ranging from about 5 to about 150 psig, preferably a pressure ranging from about 10 to about 60 psig, and more preferably at a pressure ranging from about 25 to about 45 psig. Steam, by line 77, and an oxygen-containing gas such as air, commercial oxygen or air enriched with oxygen by line 78 are passed via line 79 into gasifier 71. Reaction of the coke particles in the gasification zone with the steam and the oxygen-containing gas produces a hydrogen and carbon monoxide-containing fuel gas. The gasifier product fuel gas, which may further contain some entrained solids, is removed overhead from gasifier 71 by line 57 and introduced into heater 41 to provide a portion of the required heat as previously described.

While the fluid coking process has been described for simplicity of description with respect to circulating coke as a fluidized medium, it is to be understood that the fluidized seed particles on which the coke is deposited in the coker may be silica, alumina, zirconia, magnesia, calcium oxide, alundum, mullite, bauxite or the like. The fluidized solids may or may not be catalytic in nature.

Returning to line 65, the heater gaseous effluent containing entrained solids is passed via line 65, if desired, through an indirect heat exchanger 81 and then into cyclone 83 in which a portion of the entrained solids is separated and removed from the cyclone as dry fines by line 85. A gaseous hydrogen and carbon monoxide-containing gas stream including the remaining entrained solids is removed from cyclone 83 by line 87 and passed through a wet scrubber 89 such as, for example, a venturi scrubber, a packed bed, a wet cyclone or other conventional equipment in which a solids-containing gas is scrubbed with a liquid introduced by line 91. The scrubbed fuel gas is recovered by line 93 and passed via line 95 to a gas cleanup process shown at 97, such as, for example, a conventional Stretford process. The fuel gas is recovered from the gas cleanup process by line 98. The scrubbing liquid may be water, a water solution containing a chemical reactant or absorbing agent, or a hydrocarbon oil such as, for example, a gas oil. When water is used as the scrubbing liquid in the scrubber, at least a portion of the solids present in the gaseous stream is separated from the gas to form, with the scrubbing water, a dilute solids-water slurry which is removed from the scrubber by line 99. The dilute slurry also comprises acidic gases such as $CO_2$, $H_2S$ and COS. A portion of the dilute slurry of solids and water is recycled to the wet scrubber 89 via line 101. Another portion of the dilute slurry is passed via line 103 to a stripping zone 105 in which the slurry is contacted with a stripping gas introduced into the stripping zone via line 107 to remove at least a portion of the acidic gases from the water-solids slurry. Typically, the stripping gas is steam. In accordance with the present invention, at least a portion of the cryogenic fractionator overhead gas, which was recovered by line 121, is passed to stripping zone 105. If desired, steam may additionally be introduced via line 107 into the stripping zone as well as other inert gases. Preferably, the stripping gas will comprise steam and the cryogenic fractionator overhead gas, for example, about 67 mole percent steam and about 33 mole percent cryogenic fractionator overhead gas. The cryogenic overhead gas may be introduced into the stripping zone separately or, as shown in the FIGURE, it may be combined with the steam and introduced as a mixed stream into the stripping zone. The use of the cryogenic overhead gas as stripping gas thus provides less steam requirement for the process. The vaporous effluent of the stripping zone, which comprises the stripped acidic gases, is removed from the stripping zone via line 109 and passed into line 95 for introduction into the gas cleanup unit. For example, the gas cleanup process may be a process for removal of hydrogen sulfide, such as the Stretford process in which hydrogen sulfide is removed as sulfur from the gas that is being treated. The Stretford process is an adsorptive method employing an alkaline solution comprising one or more anthraquinone disulfonic acid. The solution may further contain a metal vanadate or a salt of a divalent metal. Further details concerning the Stretford process may be found in *Hydrocarbon Processing*, Volume 52, No. 4, April 1973, page 109. Alternatively, the vaporous effluent of the stripping zone may be passed into line 87 for introduction into the wet scrubber. The stripped water-solids slurry is removed from stripper 105 by line 111.

What is claimed is:

1. In an integrated coking and gasification process comprising the steps of:

(a) reacting a carbonaceous material in a coking zone containing a bed of fluidized solids maintained at fluid coking conditions to produce coke and a vapor phase product including hydrocarbons, said coke depositing on said fluidized solids;

(b) separating from said vapor phase product a gas comprising hydrogen and nitrogen and methane;

(c) introducing a portion of said solids with the coke deposit thereon into a heating zone operated at a temperature greater than said coking zone temperature to heat said portion of solids;

(d) recycling a first portion of heated solids from said heating zone to said coking zone;

(e) introducing a second portion of said heated solids to a fluid bed gasification zone maintained at a temperature greater than said heating zone;

(f) reacting said second portion of heated solids in said gasification zone with steam and an oxygen-containing gas to produce a hot gaseous stream comprising hydrogen;

(g) introducing said hot gaseous stream comprising hydrogen and entrained solids into said heating zone;

(h) passing an additional stream of solids from said gasification zone to said heating zone;

(i) recovering from said heating zone the resulting cooled gaseous stream comprising hydrogen, acidic gases and entrained solids;

(j) separating at least a portion of said entrained solids from said cooled gaseous stream of step (i);

(k) scrubbing the resulting gaseous stream containing said solids with a liquid to form a liquid-solids slurry containing acidic gases and recovering a scrubbed fuel gas;

(l) contacting the liquid-solids slurry with a stripping gas in a stripping zone to remove at least a portion of the acidic gases from said slurry and then passing the vaporous effluent from the stripping zone to a gas cleanup unit, the improvement which comprises passing at least a portion of said separated gas of step (b) to said stripping zone of step (l).

2. The process of claim 1 wherein said separated gas of step (b) comprises about 50 mole percent hydrogen, about 10 mole percent nitrogen and about 40 mole percent methane.

3. The process of claim 1 wherein said stripping gas of step (l) comprises said separated gas of step (b) and steam.

4. The process of claim 1 wherein said stripping gas of step (l) comprises about 33 mole percent of said separated gas of step (b) and about 67 mole percent steam.

5. The process of claim 1 wherein said carbonaceous material of step (a) comprises a hydrocarbonaceous oil.

6. The process of claim 1 wherein said carbonaceous material of step (a) comprises a hydrocarbonaceous oil containing solids.

7. The process of claim 1 wherein said carbonaceous material is a coal liquefaction bottoms.

8. The process of claim 1 wherein said zone of step (k) for removal of acidic gases is a zone for removal of hydrogen sulfide.

9. The process of claim 1 wherein said fluid coking conditions include a temperature ranging from about 850° to about 1400° F.

10. The process of claim 1 wherein said fluid coking conditions include a temperature ranging from about 900° to about 1200° F.

11. In a combination coal liquefaction, fluid coking and gasification process which comprises the steps of:

(a) subjecting coal to coal liquefaction conditions in the presence of a hydrogen donor solvent in a coal liquefaction zone to produce a hydrocarbonaceous liquid product and a coal liquefaction bottoms fraction;

(b) passing said coal liquefaction bottoms fraction to a fluid coking zone containing a bed of fluidized solids maintained at fluid coking conditions to produce coke and a vapor phase product including hydrocarbons, said coke depositing on said fluidized solids;

(c) separating from said vapor phase product a gas comprising hydrogen, nitrogen, and methane;

(d) introducing a portion of said solids with a coke deposit thereon into a heating zone operated at a temperature greater than said coking zone temperature to heat said portion of solids;

(e) recycling a first portion of heated solids from said heating zone to said coking zone;

(f) introducing a second portion of said heated solids to a fluid bed gasification zone maintained at a temperature greater than said heating zone temperature;

(g) reacting said second portion of heated solids in said gasification zone with steam and an oxygen-containing gas to produce a hot gaseous stream comprising hydrogen;

(h) introducing said hot gaseous stream comprising hydrogen and entrained solids into said heating zone;

(i) passing an additional stream of solids from said gasification zone to said heating zone;

(j) recovering from said heating zone the resulting cooled gaseous stream comprising hydrogen, acidic gases and entrained solids;

(k) separating at least a portion of said entrained solids from said cooled gaseous stream of step (j);

(l) scrubbing the resulting gaseous stream containing said solids with a liquid to form a liquid-solids slurry comprising acidic gases and recovering a scrubbed fuel gas;

(m) contacting the liquid-solids slurry with a stripping gas in a stripping zone to remove at least a portion of the acidic gases therefrom and then passing the vaporous effluent from the stripping zone to a gas cleanup unit, the improvement which comprises passing at least a portion of said separated gas of step (c) to said stripping zone of step (m).

12. The process of claim 11 wherein a molecular hydrogen-containing gas is introduced into said coal liquefaction zone.

13. The process of claim 11 wherein said fluid coking conditions include a temperature ranging from about 850° to about 1400° F.

14. The process of claim 11 wherein said fluid coking conditions include a temperature ranging from about 900° to about 1200° F.

15. The process of claim 11 wherein said coal liquefaction conditions include a temperature ranging from about 700° to about 950° F. and a pressure ranging from about 300 psia to about 3000 psia.

16. The process of claim 11 wherein said separated gas of step (c) comprises about 50 mole percent hydrogen, about 10 mole percent nitrogen and about 40 mole percent methane, and being substantially free of heavier hydrocarbons.

17. The process of claim 11 wherein said stripping gas of step (m) comprises said separated gas of step (c) and steam.

18. The process of claim 11 wherein said stripping gas of step (m) comprises about 33 mole percent of said separated gas of step (c) and about 67 mole percent of steam.

* * * * *